US005855442A

United States Patent [19]

Keller

[11] Patent Number: 5,855,442

[45] Date of Patent: Jan. 5, 1999

[54] COMBINED WHITEBOARD MARKING PEN AND ERASER

[76] Inventor: Scott A. Keller, 22645 Summit Rd., Los Gatos, Calif. 95030

[21] Appl. No.: 746,785

[22] Filed: Nov. 15, 1996

[51] Int. Cl.[6] ..... B43K 29/02; B43K 9/00

[52] U.S. Cl. ..... 401/195; 15/424; 15/427; 15/428; 15/431; 401/52; 401/202

[58] Field of Search ..... 15/424, 425, 426, 15/427, 428, 429, 430, 431, 432; 401/202, 195, 52

[56] References Cited

U.S. PATENT DOCUMENTS

| | | | |
|---|---|---|---|
| 330,388 | 10/1885 | Choi | 401/195 X |
| 426,950 | 4/1890 | Negraval | 15/427 |
| 1,473,090 | 11/1923 | Ferry | 15/428 |
| 2,039,410 | 5/1936 | Harris | 15/432 |
| 2,097,317 | 10/1937 | Comstock | 15/432 |
| 2,266,429 | 12/1941 | Lopez | 15/432 X |
| 2,690,735 | 10/1954 | Lopez | 15/432 |
| 4,937,910 | 7/1990 | Frazier | 15/231 |
| 5,072,483 | 12/1991 | Durand | 15/210 |
| 5,432,973 | 7/1995 | Wagner et al. | 15/210 |
| 5,451,114 | 9/1995 | Ishigaki | 401/202 |

FOREIGN PATENT DOCUMENTS

| | | | |
|---|---|---|---|
| 1337623 | 8/1963 | France | 15/428 |
| 16751 | of 1894 | United Kingdom | 15/428 |

*Primary Examiner*—Steven A. Bratlie
*Attorney, Agent, or Firm*—Skjerven Morrill MacPherson Franklin & Friel LLP; Thomas S. MacDonald

[57] ABSTRACT

A whiteboard marking pen includes an ink-containing pen casing having an ink applicator extending from a first end of the casing and a plug socket in a second end of the pen casing; a cylindrical pen cap including a socket end surrounding the ink applicator in a capped storage state and a plug first end insertible into the pen casing plug socket in a pen uncapped marking state; and a whiteboard eraser juxtaposed to a cylindrical portion of the pen cap and extending cantilevered outwardly with respect to a distal surface of the cap socket end, such that, when the pen cap is plugged into the pen casing plug socket, a peripheral edge of the cantilevered eraser is positioned for erasing a minor area of an ink image on a whiteboard.

21 Claims, 3 Drawing Sheets

COMBINED WHITEBOARD MARKING PEN AND ERASER

BACKGROUND OF INVENTION

A white laminate display panel commonly known as a 'whiteboard', has all but replaced the classic chalkboard (a.k.a. blackboard) everywhere from classrooms to boardrooms.

Like a chalkboard, use of a whiteboard involves writing on the board that can later be erased, allowing reuse of the board indefinitely. This writing is accomplished with a pen containing ink specially formulated for quick drying and the ability to be erased. Necessarily, the pen must be kept capped when not being used. Erasure of any significant magnitude is normally accomplished with a very light rubbing of the surface using a felt brick—quite similar to those used with chalkboards. However, whiteboard erasure is generally easier then with a chalkboard. Consequently, even more often than with chalkboards, one frequently observes presenters using their fingers for minor erasures. Reasons for doing this are varied but can be generally summed up in two ways. For small erasures, it is much quicker and easier to use a finger then taking the time (and disruption of the presentation) to reach for an eraser. Second, the stick-like shape of a finger allows for naturally more accurate small edits of an image then with a brick style eraser. This use of a finger for erasing does of course have the undesirable result of leaving residue 'ink dust' on the finger or of leaving a finger skin oil impression on the whiteboard.

What is desired is an eraser that has both the immediacy of use and the accuracy of a finger, without impact to the natural usability of the existing marking pen or cleanliness of the user.

No known prior invention addresses a solution to these needs. Some attempts, in particular U.S. Pat. No. 5,072,483, have focused on combining the features of the brick eraser (broad planer eraser surface area for bulk erasing) with those of the marking pen. In the '483 patent a curved cloth covering is attached around a portion of a marking pen cap, or attached to a planar plate extending somewhat tangentially from the cap, or on a parallel grip portion extending from the cap, or extending from a cap having opposite and apertures for receiving two types of writing instruments. However that invention like others, does not have an attachment of the eraser i.e. the curved or flat covering 22 to the pen in a manner that allows its immediate use while the pen is in a marking state. This lack of immediacy continues the incentives to use a finger with its attendant advantages and disadvantages. Neither does the shape of that invention allow for the continued natural usability of the pen shape or cleanliness of the user. It is also obvious to infer from the provided drawings of the '483 invention that during erasures of even a moderate degree the pen may 'fly off the handle' from the eraser. Nor does the '483 patent present a shape that is conducive to fine erasures. Certainly any beneficial results that may accrue from '483 patent compete with, rather then supplement those of the brick eraser, and yet do nothing to address the incentives for using one's finger. Likewise U.S. Pat. No. 5,432,973 incorporates a brick-type whiteboard eraser on a holder for three marking pens.

SUMMARY OF THE INVENTION

The invention disclosed herein embodies these four previously unavailable yet desired characteristics by its novel integration of eraser material with the marking pen achieving immediacy to the work area, natural accuracy of erasures, and no degradation in previous pen usability and with improved cleanliness of the whiteboard and a cessession of the use of a finger by the user. Further, the distinguishing unique and beneficial characteristics of the invention include the following:

1. The invention does not materially increase the size, shape, or weight of the pen so as to impede its natural use in either marking or capped states.
2. The invention can be an integral component of the pen when manufactured, or added later even by the ultimate user. If added after manufacture, use of the invention does not incur frivolous waste (original components of the pen are not replaced or thrown away).
3. When not in use, the pen continues to be easily and securely capped so as to prevent the marking ink from drying out.
4. When uncapped for marking, the cap reattaches to the pen in a no less easy and secure manner than in its unimproved form—allowing free and natural use of the pen in its uncapped state or alternative use of the eraser.
5. As a direct result of the invention, when the pen is uncapped, the user has immediate and unencumbered access for either marking or erasing functions.
6. As a direct result of the invention in both capped or uncapped states, the invention does not unduly present the surface used for erasing to the pen body or users hand thus minimizing transference of ink dust to the user.

The inventive construction for erasure of whiteboard markings includes a marking pen and pen cap where the pen is configured for marking, and an eraser mechanism and eraser surface to be used is attached to the pen cap or pen casing generally facing 180 degrees from that of the marking surface in the uncapped marking state.

In one embodiment eraser material in the form of a torus is attached around the full circumference of the cap, the eraser material extending cantilevered past the cap edge such that when the cap is reattached to the pen in marking configuration, the eraser material can be used for erasing without the cap material scratching or touching the whiteboard surface. In another embodiment eraser material is attached to the cap around a partial circumference of the cap, the eraser material extending past the cap edge such that when the cap is reattached to the pen in marking configuration, the eraser material can be used for erasing without the cap material scratching or touching the whiteboard surface by merely reversing the direction of use of the pen and cap. In an additional embodiment eraser material is attached to another material such as a metal or plastic which is shaped in a clip-like configurations) and securely attached to the inner edge of the cap such that when the cap is reattached to the pen in marking configuration, the eraser material can be used for erasing also without the cap material scratching or touching the whiteboard surface. In still another embodiment eraser material is attached to a metal or plastic member and is shaped in an approximate right angle with one end shaped like a donut. The donut-shaped end includes fingers or flanges around the inner hole such that when placed over and then pushed down over a cap protrusion it well be semi-permanently attached in a secure manner. The other end of the metal or plastic member is attached to the eraser material such that when the cap is reattached to the pen in a marking configuration, the eraser material can be used for erasing without the cap material scratching or touching the whiteboard surface. In yet another embodiment eraser material attached to a metal or plastic member which is securely attached to the body of the marking pen, the material being shaped so as to extend the eraser material past the end of the pen casing such that with or without the cap attached into its holding configuration (pen in marking state), the eraser material can be used for erasing without the cap material scratching or touching the whiteboard surface.

The whiteboard marking pen includes an ink-containing pen casing having an ink applicator extending from a first end of the casing and a plug socket in a second end of the pen casing; a cylindrical pen cap including a socket end surrounding the ink applicator in a capped storage state and a plug first end insertible into the pen casing plug socket in a pen uncapped marking state; and a whiteboard eraser juxtaposed to a cylindrical portion of the pen cap and extending cantilevered outwardly with respect to a distal surface of the cap socket end, such that, when the pen cap is plugged into the pen casing plug socket, a peripheral edge of the cantilevered eraser is positioned for erasing a minor area of an ink image on a whiteboard.

DETAILED DESCRIPTION

Figure 1:
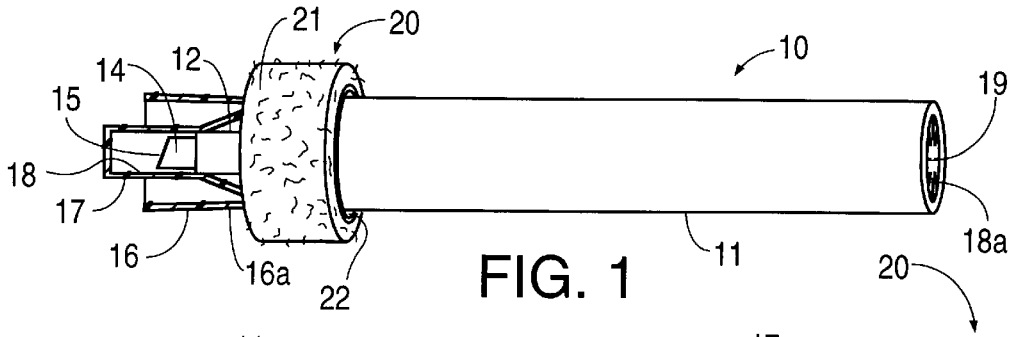
FIG. 1 is a side view partially broken away of a first embodiment of the invention with the pen cap in section and the eraser in perspective and the marking pen in a capped storage state.
Figure 2:
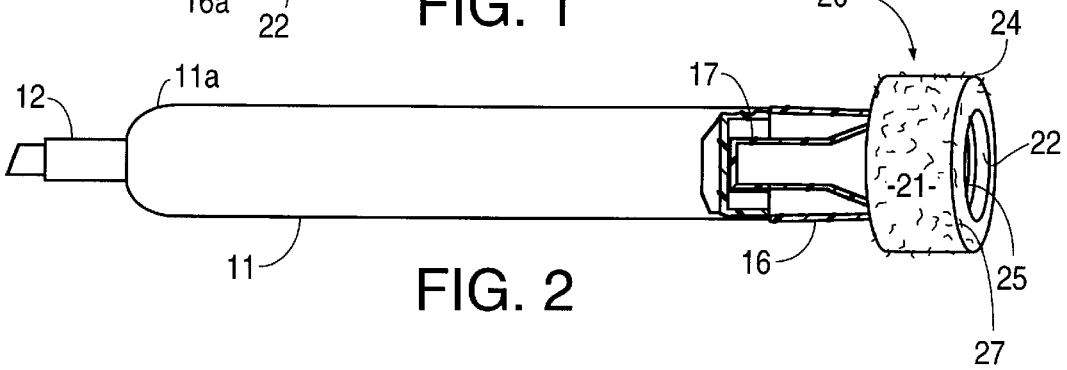
FIG. 2 is a similar view thereof in an uncapped marking state.

A typical whiteboard marker 10 as shown in FIG. 1 includes a pen casing 11 containing erasable whiteboard marking ink (not shown) and a cylindrical applicator or applicator base 12 having a felt nib 14 which normally has a skewed end 15 for fine line writing. A pen cap 16 includes a cylindrical plug end 17 and a socket end 18 into which the cylindrical applicator base 12 is insertible in a holding force fit in a capped storage state and which is easily hand-removable therefrom. As seen in FIG. 2 in an uncapped marking state the plug end 17 is insertible into a plug socket 19 (FIG. 1) in an end of the pen casing opposite to the applicator base 12. Thus the pen cap is stored on an 180° removed end of the marking pen in a holding force fit and is hand-removable from the plug socket 19 when it is desired to re-cap the applicator base. The cap socket end 18 typically has internal integral, longitudinally—extending flexible fingers 18*a* which receive the applicator base and the nib. The above recitation reflects the construction of a typical whiteboard marking pen of the prior art. These prior art pens are available from Sanford Corp., Bellwood Ill. as "EXPO" pens or Baker School Specialty Co. of Orange Mass. as "BAKER" pens. Also shown in FIG. 1 and FIG. 2 is the first embodiment of the invention where an eraser structure 20 including a material 21 such as a Velcro® sheet, preferably a closed loop portion thereof, or other pile fabric erasure strip (for example, polypropylene) is mounted by an adhesive such as #8056 from the 3M Co. on a torus ring 22 of rigid plastic of the same plastic material used in the prior art marking casings or of fairly rigid synthetic rubber or the like and either adhesively attached or in a firm force fit on the cylindrical periphery 16*a* of the pen cap 16. The internal diameter of the ring 22 is such as to easily slide over and overlap a diametric portion 11*a* (FIG. 2) of casing 11 adjacent to the applicator base 12.

Figure 3:
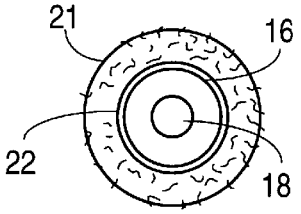
FIG. 3 is a distal end view of the pen cap in the uncapped marking state.

When the pen cap 16 is hand-removed from the applicator base 12, the cap is then transferred 180° to the end of the casing opposite the applicator base 12 and the end plug 17 is inserted (FIG. 2) into the plug socket 19 of the pen casing 11 so that the overall marking pen is in the uncapped marking state. A portion 24 of the torus ring and its attached eraser material 21 extends cantilevered outwardly with respect to a distal end surface 25 of the cap socket end. This allows a user to employ a sharp or rounded peripheral edge 27 of the material 21 and to hand manipulate the pen casing 11 (flipping the overall pen 180° ) to then erase either a large or minor area representing a short line, small image, letter or number, which one is desirous of deleting from a previously ink marked inscription on the whiteboard. FIG. 3 shows an end view of the torus ring, the eraser material and the distal end of the pen cap socket end 18.

Figure 4:
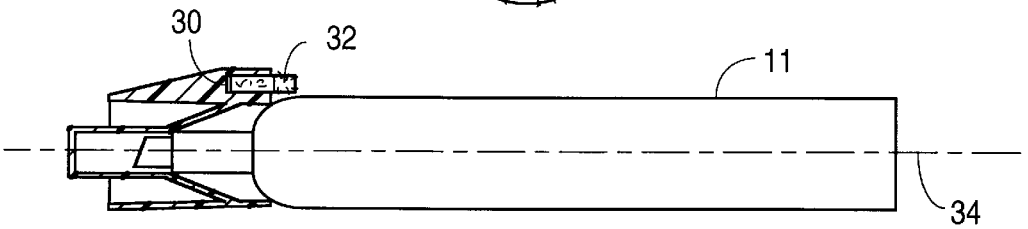
FIG. 4 is a side view of a second embodiment with the pen cap and eraser in section in the capped storage state.
Figure 5:
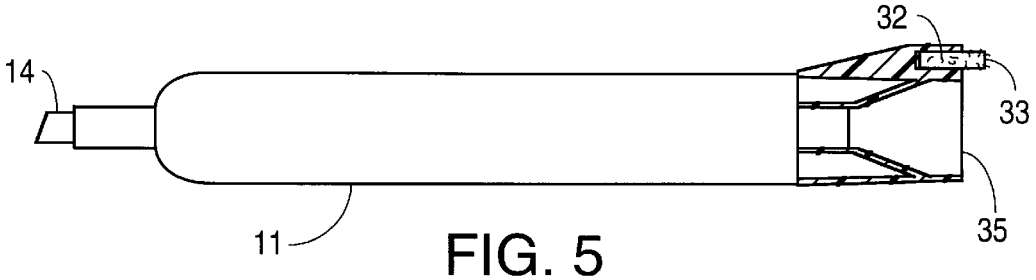
FIG. 5 is a similar view thereof in the uncapped marking state.
Figure 6:
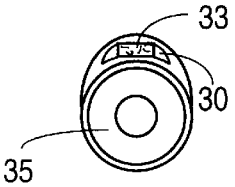
FIG. 6 is an end view thereof showing the socket end of the pen cap.

FIGS. 4–6 illustrate the second embodiment of the invention where an arcuate groove 30 is formed in a distal end of the pen cap 31 and an arcuate or linear eraser 32 of Velcro® sheet or "Nylon" pile fabric material or other fibrous felt or material is inserted into the groove 30 using a suitable adhesive and a portion 33 extends outwardly of the cap distal end 35. Alternatively, the material may be mounted on a rubber or plastic base (not shown) which is inserted into and adhesively secured in the groove 30. As in the prior embodiment a portion 33 of the material 32 extends cantilevered outwardly of the distal socket end of the pen cap, extends parallel to the central longitudinal axis 34 of the marking pen and is spaced (1–3 mm) from the casing periphery in the capped storage state. As seen in FIG. 5 in the uncapped marking state the material 32, particularly cantilevered end 33, is positioned 180° from the ink nib 14 and is suitable for erasing even small images by flipping the marking pin 180°.

Figure 7:
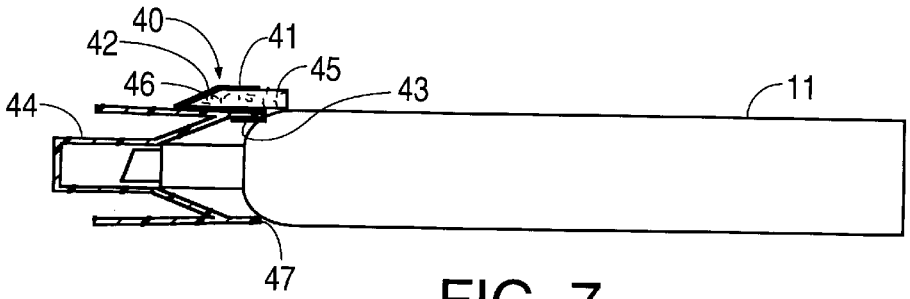
FIG. 7 is a side view of a third embodiment with the pen cap and eraser in section in a capped storage state.
Figure 8:
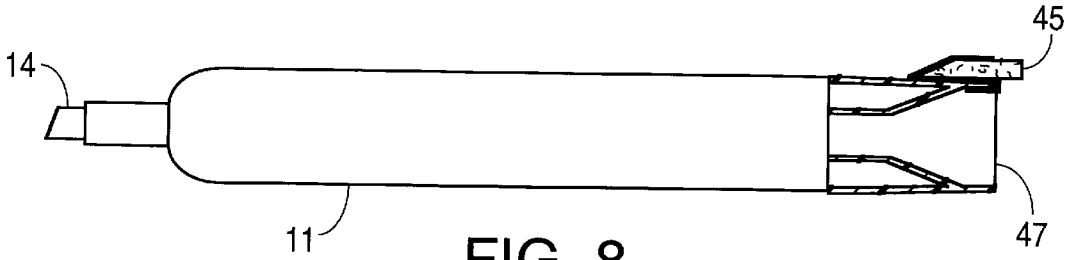
FIG. 8 is a similar view in the uncapped marking state.
Figure 9:
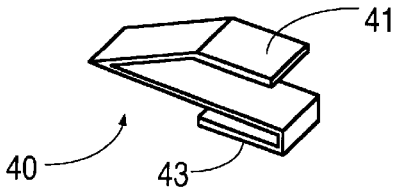
FIG. 9 is a perspective view of the clip shown in FIG. 8.

FIGS. 7–9 show a third embodiment of the invention where an eraser material 45 of the type previously disclosed is inserted into one end 41 of an S-shaped spring clip 40 with an angular portion 46 of the eraser seating in an angular top portion 42 of the clip. The other bottom portion 43 of the clip is clipped into or molded into the modified pen cap 44. As in the previous embodiments a cantilevered end 45 of the eraser extends outwardly from the distal end 47 of the pen cap in a position to erase a small image on the whiteboard. The spring clip may be a spring metal clip or a C-shaped plastic clip corresponding generally to the shape of the clip angular top portion 42 and integrally molded on the pen cap.

Figure 10:
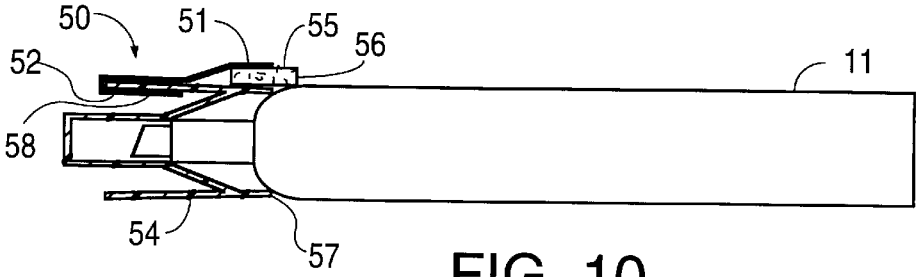
FIG. 10 is a side view of a fourth embodiment of the invention with the pen cap and eraser in section in the capped storage state.
Figure 11:
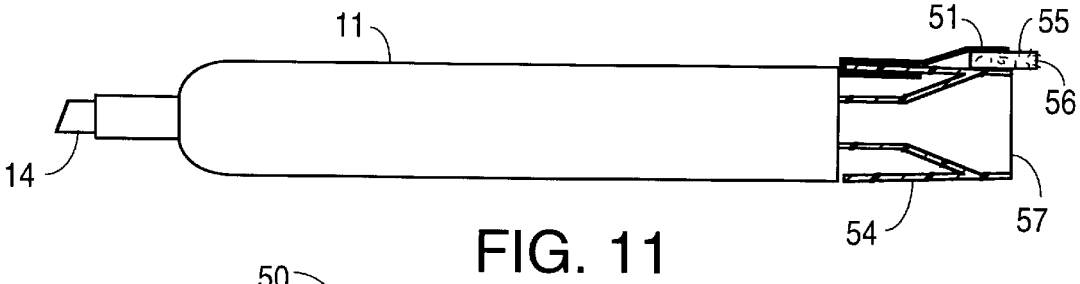
FIG. 11 is a similar view in the uncapped marking state.
Figure 12:
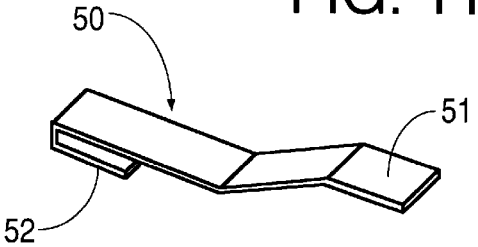
FIG. 12 is a perspective view of the clip shown in FIG. 11.

FIGS. 10–12 illustrate a fourth embodiment of the invention where a clip 50 has a first end 51 on which erasure material 55 is adhered by an adhesive to seat between the clip end and the pen cap 54 periphery. The opposite end 52 of the clip is inserted into a slot 58 in the cap plug end. As seen in FIG. 11 a portion 56 of the material is cantilevered outwardly from the distal end 57 of the cap.

Figure 13:
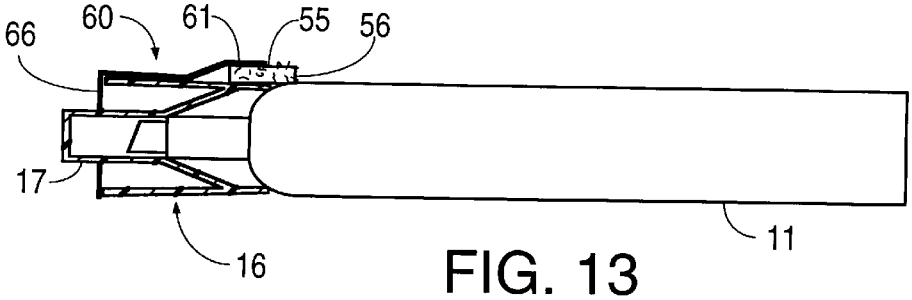
FIG. 13 is a side view of a fifth embodiment of the invention with the pen cap and eraser in section in the capped storage state.
Figure 14:
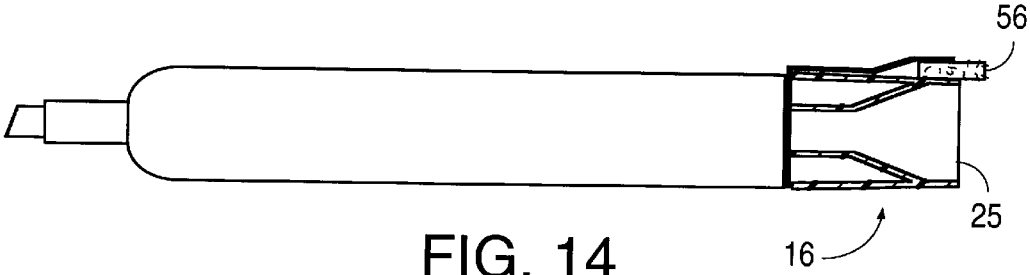
FIG. 14 is a similar view in the uncapped marking state.
Figure 15:
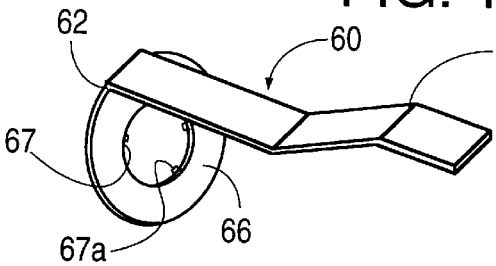
FIG. 15 is a perspective view of the clip shown in FIG. 14.

FIGS. 13–15 show a fifth embodiment of the invention where a clip 60 includes a first end 61 mounting erasure material 55 as in the fourth embodiment, and a second end 62 extending generally at a right angle in the form of an integral donut-shaped flat ring 66 having a central aperture 67 (FIG. 15) with radial inwardly-directed fingers 67*a* which snugly fit over the plug end 17 of the pen cap 16. In this embodiment the pen cap 16 per se is not modified from prior art pen caps, the clip 60 being an add-on. Like the other embodiments, an end 56 of the erasure material extends cantilevered outwardly of a distal end 25 of pen cap 16.

Figure 16:
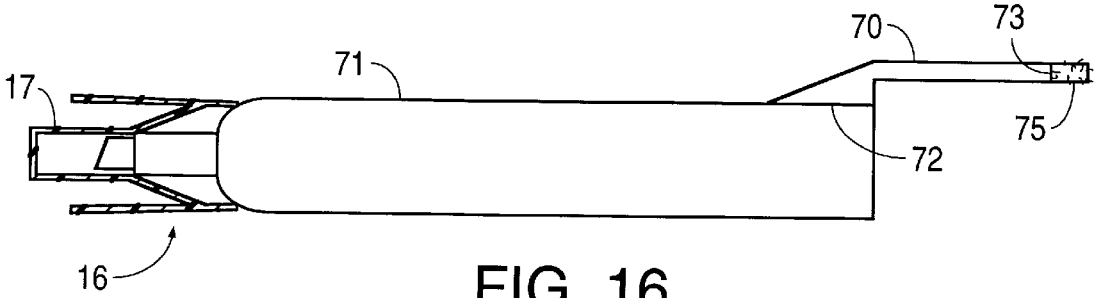
FIG. 16 is a side view of a sixth embodiment of the invention with the pen cap and eraser in section.
Figure 17:
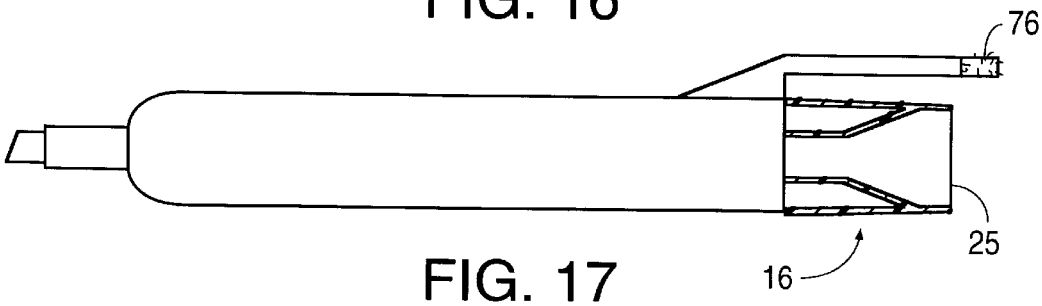
FIG. 17 is a similar view in the uncapped marking state.
Figure 18:
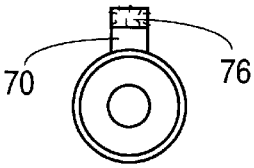
FIG. 18 is an end view thereof showing the socket end of the pen cap and eraser.

FIGS. 16–18 illustrate a sixth embodiment where an integral extension 70 extends from the periphery of an end 72 of the marking pen casing 71. An eraser material 75 of the types discussed above, is adhered by the adhesive set forth above, to a linear or arcuate tip 73 of the extension 70. In this embodiment (FIG. 17) the entire eraser 76 is cantilevered outwardly of the distal end 25 of the cap 16. As in the fifth embodiment the pen cap 16 is not modified from prior art pen caps.

The above description of embodiments of this invention is intended to be illustrate and not limiting. Other embodiments of this invention will be obvious to those skilled in the art in view of the above disclosure.

I claim:

1. A whiteboard marking pen including an ink-containing plastic pen casing having an ink applicator extending from a first end of the casing and a plug socket in a sednd end of the pen casing; and a plastic cylindrical pen cap including a socket end surrounding the applicator in a capped storage state and a central plug end insertible into the pen casing plug socket in a pen uncapped marking state and an exposed whiteboard eraser of pile fabric, felt or hook and loop material juxtaposed to a cylindrical portion of the pen cap and extending cantilevered outwardly with respect to a distal surface of the pen cap socket end, such that, when the plug end of the pen cap is plugged into the pen casing plug socket, a peripheral edge of the cantilevered eraser is positioned for erasing a minor area of an ink image on a whiteboard.

2. The marking pen of claim 1 wherein the eraser comprises a torus ring surrounding and attached to a cylindrical periphery of the socket end of the pen cap, a portion of the torus ring forming the cantilevered portion of the eraser.

3. The marking pen of claim 2 wherein an interior cylindrical portion of the torus ring is sized to peripherally overlap a portion of the pen casing adjacent to the ink applicator.

4. The marking pen of claim 1 wherein the eraser is attached to and extends from the pen cap distal surface.

5. The marking pen of claim 4 wherein the pen cap distal surface includes an arcuate groove, the eraser being of a corresponding arcuate shape and being adhesively mounted in the arcuate groove.

6. The marking pen of claim 1 further including an eraser mounting clip, the clip including an eraser holding portion and a clip mounting portion clipable to the pen cap to hold the eraser on the pen cap.

7. The marking pen of claim 6 wherein the clip mounting portion is insertible over the pen cap socket end.

8. The marking pen of claim 6 wherein the clip mounting portion is insertible into the pen cap plug end.

9. The marking pen of claim 8 wherein the clip mounting portion is insertible into a peripheral edge of the pen cap plug end.

10. The marking pen of claim 8 wherein the clip mounting portion includes a toroidal ring surrounding and abutting the pen cap plug end.

11. The marking pen of claim 10 wherein the toroidal ring abuts an annular surface surrounding a root of the pen cap plug first end.

12. The marking pen of claim 1 wherein the cantilevered eraser includes a mounting arm extending from and attached to a peripheral portion of the pen casing.

13. The marking pen of claim 12 wherein the mounting arm is integral with the pen casing.

14. The marking pen of claim 12 wherein the mounting arm extends parallel to a longitudinal central axis of the marking pen.

15. The marking pen of claim 13 wherein the mounting arm extends distally outward from the casing plug socket in the capped storage state.

16. The marking pen of claim 1 wherein in the capped storage state the eraser is attached to the pen cap and extends peripherally outward of and along a cylindrical portion of the pen casing adjacent to the pen casing first end inboard of the ink applicator.

17. A whiteboard marking pen including an ink-containing pen casing having an ink applicator extending from a first end of the pen casing;

a pen cap including a socket end adapted to surround and enclose the applicator in a capped storage state, said pen cap being insertible into a second end of the pen casing in a pen uncapped marking state; and a whiteboard eraser of pile fabric, felt or hook and loop material juxtaposed to the pen cap socket end and having a portion extending cantilevered outwardly with respect to a distal surface of the pen cap socket end, such that when the pen cap is mounted on the second end of the pen casing, a peripheral edge of the cantilevered eraser is positioned for erasing an area of an ink image on a whiteboard.

18. The marking pen of claim 17 wherein the eraser comprises a torus ring surrounding and attached to a cylindrical periphery of the pen cap socket end, a portion of the torus ring forming the cantilevered portion of the eraser.

19. The marking pen of claim 17 wherein the eraser is attached to and extends from the pen cap distal surface.

20. The marking pen of claim 17 wherein the cantilevered eraser includes a mounting arm extending from and attached to a peripheral portion of the pen casing.

21. The marking pen of claim 17 wherein in the capped storage state the eraser is attached to the pen cap and extends peripherally outward of and along a cylindrical portion of the pen casing adjacent to the pen casing first end inboard of the ink applicator.

* * * * *